United States Patent [19]

Strawson et al.

[11] 3,989,777

[45] Nov. 2, 1976

[54] METHOD OF MAKING PERMANENT MAGNETS

[75] Inventors: Kenneth Horace Strawson; Anthony Foden, both of Sheffield, England

[73] Assignees: Strawson Hydraulics (Consultants) Limited; Balfour Darwins Limited, both of Sheffield, England

[22] Filed: July 8, 1974

[21] Appl. No.: 486,682

[30] Foreign Application Priority Data

July 16, 1973 United Kingdom ..... 33851/73

[52] U.S. Cl. ..... 264/24; 29/419 R; 29/420; 264/56; 264/61; 264/69; 264/86; 264/108; 264/111; 425/174.8 R; 425/DIG. 33

[51] Int. Cl.[2] ..... B29C 3/00

[58] Field of Search ..... 264/24, 108, 40, 86, 264/69–72, 56, 61, 111; 425/DIG. 33, 174.8 R; 29/419, 420

[56] References Cited

UNITED STATES PATENTS

| | | | |
|---|---|---|---|
| 1,703,871 | 3/1929 | Curtis | 264/86 |
| 2,632,227 | 3/1953 | Steele et al. | 264/86 |
| 3,024,392 | 3/1962 | Baermann | 264/24 |
| 3,042,594 | 7/1962 | Hauth | 264/69 |
| 3,066,355 | 12/1962 | Schloemann et al. | 264/69 |
| 3,234,598 | 2/1966 | Quinn | 425/DIG. 33 |
| 3,264,716 | 8/1966 | Silver | 425/DIG. 33 |
| 3,452,121 | 6/1969 | Cochardt et al. | 264/108 |
| 3,530,551 | 9/1970 | Haes et al. | 264/24 |
| 3,634,559 | 1/1972 | Haes et al. | 264/24 |
| 3,792,134 | 2/1974 | Paulson | 264/40 |
| 3,842,148 | 10/1974 | Loubier | 264/24 |

*Primary Examiner*—Willard E. Hoag
*Attorney, Agent, or Firm*—Young & Thompson

[57] ABSTRACT

The production of permanent magnets by a method including the injection of a slurry of magnetic material into a fixed capacity mould from which excess water can escape through a filter, the injection of the slurry being effected at a pressure sufficient to achieve the required density of finished compact.

1 Claim, 2 Drawing Figures

METHOD OF MAKING PERMANENT MAGNETS

Figure 1:
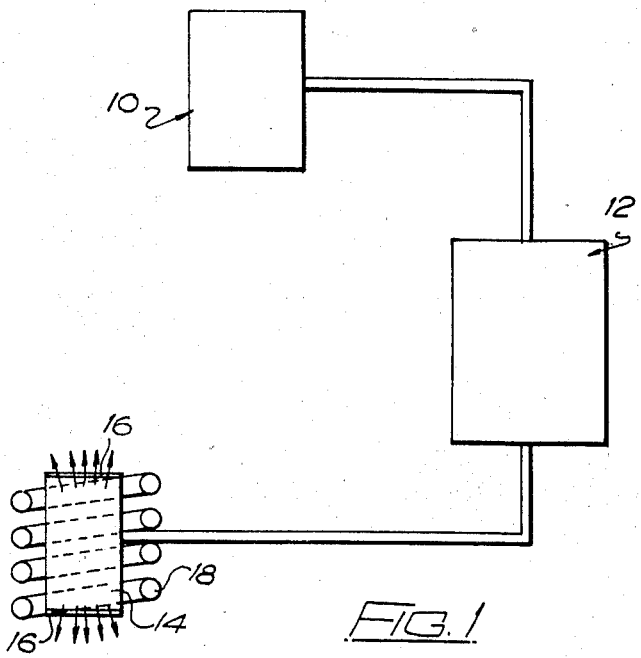

The invention relates to the production of permanent magnets and has for its object to provide an improvement therein.

It is known to produce permanent magnets by a method which includes the steps of mixing a permanent magnetic material with water to form a slurry, grinding the slurry to achieve an optimum particle size of the material, and pumping the slurry to a compacting die and applying pressure to the slurry in the compacting die by means of vertically opposed rams to force out excess water through filters as a magnetic field is maintained around the die so that the particles of magnetic material are correctly orientated whilst still suspended in the slurry. When the required density has been achieved, the compact which has itself become magnetised is de-magnetised and then removed from the die and subsequently fired in an oxidising atmosphere to achieve the required fired density and magnetic properties.

However, this known process has certain disadvantages. For example, a particular relatively high water content is required to achieve the correct grinding performance and to achieve the optimum particle size of the permanent magnetic material. In addition, due to the necessity for the slurry to be capable of being pumped easily to the compacting die it must contain more water than is required for facilitating the correct orientation of the particles within the die under the influence of the magnetic field. Consequently, a compacting die which is deep in relation to the required thickness of the finished compact of material is required. Furthermore, since a large volume of water has to be removed from the die through the filters (which must be of very fine mesh because of the very small particle size of the permanent magnetic material) the process is slow. Effective seals are required to seal the clearances between the rams and the bores in which they are slidable, and these seals are prone to rapid deterioration due to the highly abrasive nature of the magnetic material. It is the object of the invention at least to alleviate these disadvantages.

According to one aspect of the invention, there is provided a method of producing permanent magnets, the method including the steps of mixing a permanent magnetic material with water to form a slurry, and injecting the slurry into a mould cavity, from which excess water can escape through a filter, with sufficient pressure to achieve the required density of finished compact as a magnetic field is maintained around the mould so that the particles of magnetic material are correctly orientated whilst still suspended in the slurry. The method will preferably include the step of partially de-watering the slurry before it is injected into the mould cavity. The method will preferably also include the timing of the period during which the pressure is maintained in the mould cavity and may include the application of varying pressures for carefully controlled periods of time. It may include also the variation of the rate of slurry injection into the mould. The method may include the step of cleaning or of replacing the filter after each compact of material has been produced. The method may also include the step of maintaining a magnetic field around a feed passage through which the slurry is injected into the mould cavity so that the particles of magnetic material are at least partially orientated before entering the mould cavity. In addition, the method may include the step of imparting vibrations to the mould or to the feed passage to the mould, or to both, as the slurry is injected into the mould cavity and/or as pressure is applied to achieve the required density of finished compact so that the injection of the slurry into the mould cavity is facilitated and/or so that the correct orientation of the particles of magnetic material under the influence of the magnetic field is facilitated.

Figure 2:
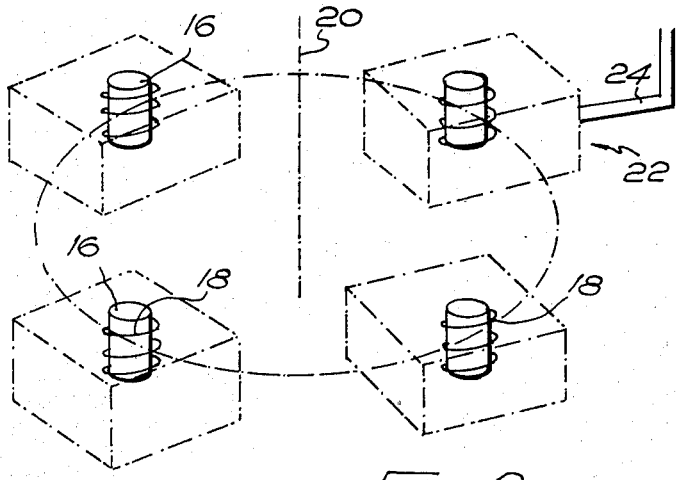

In order that the invention may be fully understood and readily carried into effect, the same will now be described, by way of example only, with reference to the accompanying drawings, of which:

FIG. 1 is a diagrammatic view of apparatus for practicing the method of the invention, and FIG. 2 is a diagrammatic view which illustrates a modification which will presently be described.

Referring now to FIG. 1 of the drawings, the apparatus there illustrated for producing permanent magnets includes means generally indicated 10 for mixing a permanent magnetic material, in this case a ferro-magnetic compound, with water to form a slurry, the slurry being ground therein to achieve an optimum particle size of the ferro-magnetic material. The apparatus also includes means generally indicated 12 for partially de-watering the slurry and for injecting the partially de-watered slurry into a mould cavity 14. The de-watering means can be any conventional mechanism known to persons skilled in this art.

The mould cavity 14 is a fixed volume cavity in a split mould (but the manner in which the mould is split is not illustrated in FIG. 1; suffice to say that it can be of a form in which any cast product is normally produced — for example a die casting — and it may include movable cores or inserts to produce a cored or difficult to produce cast shape of product). The mould is provided with respective filter elements 16 at its opposite ends and the arrangement is such that the flow of excess water is allowed therethrough.

The means generally indicated 12 are such that the partially de-watered slurry can be injected into the mould cavity with sufficient pressure to achieve the required density of finished compact without any compression of the material therein by mechanical means, that is to say without the need for rams acting in the mould cavity. Timing means, not shown, are provided for timing the period during which the pressure is maintained in the mould cavity, said timing means being such that varying pressures can be applied for carefully controlled periods of time. The means 12 are also such that the rate of injection of the slurry into the mould cavity can be varied.

The mould is surrounded by a coil 18 which can be energised to establish a magnetic field around the mould as the partially de-watered slurry is being injected into the mould cavity and whilst hydrostatic pressure is being applied to compact the material in the mould cavity. This has the effect of correctly orientating the particles of ferro-magnetic compound within the mould cavity whilst they are still suspended in the slurry, that is to say before the excess water has been driven out to such an extent that the particles are unable to align themselves with the lines of force provided by the magnetic field (and it will be understood that when partially de-watered in the means indicated 12 the slurry will still be such that it can easily be injected into the mould cavity and such that the particles of material are still in suspension so that they can readily align themselves under the influence of a magnetic field). The compact must be de-magnetised before it is removed from the mould, conveniently by reversing the coil current.

Various modifications may be made without departing from the scope of the invention. For example, in FIG. 2 there is illustrated a modification in which a plurality of moulds 14, ecch provided with filters 16, are mounted on means capable of being indexed about a vertical axis 20 for bringing each one in turn to a work station 22. At the work station there is provided means for coupling a feed passage 24 to a mould located thereat so that the partially de-watered slurry can be injected into the mould cavity. Also at the work station there are located electrical contact means (not shown) for automatically establishing an electric circuit through the respective coil 18 when a particular mould is brought into position at the work station (each mould being provided as shown with its own built-in coil). The indexing round of the moulds may of course be under the control of the timing means referred to earlier so that the production of the required compacts of magnetic material can be at least semi-automatic.

It will be understood that the apparatus described above has a number of very important advantages over apparatus previously employed for making permanent magnets from a compact of magnetic material. One particular advantage is that a magnet of virtually any shape which can normally be cast can be produced since the mould is a fixed volume mould as opposed to a mould in which opposed rams are movable to achieve the required pressure of compaction. Thus, for example, magnets of frusto-conical form can quite easily be produced. Furthermore, since the mould is a fixed volume mould and does not include parts which are movable during the compaction process it is subjected to very little wear and the apparatus is inherently reliable and of long life expectancy. Furthermore, the mould parts do not require to be of the usual massive proportions and a large mechanical or hydraulic press is not required so that the capital cost of the apparatus is relatively low. Production cycle time has also been found to be relatively short.

Various other modifications can of course be made without departing from the scope of the invention. For example, the or each mould does not necessarily need to include two separate filters; depending on the size and shape of the finished compact required it may require a single filter or on the other hand may require more than two filters. Furthermore, means could quite conceivably be provided for establishing a magnetic field around the feed passage through which the slurry is injected into the mould cavity, as well as around the mould cavity itself, so that the particles of magnetic material will be at least partially orientated before entering the mould cavity. It may be found that the slurry does not need to be partially de-watered before being injected into the mould cavity, the de-watering then being carried out entirely in said mould. Other means could be employed for establishing a magnetic field in the region of the mould cavity, for example permanent magnets (and in this case the operation of de-magnetising the particles of magnetic material before the compact is removed from the mould may be effected either by bringing other magnets into play or by reversing the permanent magnets referred to). The work station of the embodiment illustrated in FIG. 2 could incorporate means for restraining or clamping a split mould. Although in the apparatus described the permanent magnetic material being used is said to be a ferro-magnetic compound, it will be understood that other kinds of permanent magnetic material capable of being mixed with water to form a slurry may be used.

What we claim and desire to secure by Letters Patent is:

1. A method of producing a permanent magnet compact, comprising in combination the steps of mixing an orientable permanent magnetic material with water to form a slurry, partially dewatering the slurry, injecting the partially dewatered slurry into a mold cavity, allowing excess water to escape through a filter which comprises a part of the wall that surrounds said mold cavity, applying pressure to the partially dewatered slurry in the mold cavity to achieve a further dewatering thereof to form a finished compact of the required density, said finished compact fully filling the mold cavity, maintaining a magnetic field around the mold cavity so that the particles of magnetic material are correctly oriented while still suspended in the slurry, maintaining the internal configuration of the mold unchanged throughout said further dewatering, and imparting vibrations to the mold during injection of the slurry and further dewatering of the magnetic material in the mold.

* * * * *